United States Patent [19]

Knape

[11] 4,108,076

[45] Aug. 22, 1978

[54] METHOD FOR REMOVING BALLAST FROM RAILROAD TRACKS

[76] Inventor: Fritz Knape, Mainzer Strasse 18, 8000 Munich 40, Fed. Rep. of Germany

[21] Appl. No.: 738,611

[22] Filed: Nov. 3, 1976

[30] Foreign Application Priority Data

Nov. 10, 1975 [DE] Fed. Rep. of Germany ..... 2550391

[51] Int. Cl.[2] ..... E01B 27/06

[52] U.S. Cl. ..... 104/2; 37/104; 171/16

[58] Field of Search ..... 104/2, 3, 5, 6, 7 R, 104/7 A; 171/16, 1; 37/104, 105, 106, 107

[56] References Cited

U.S. PATENT DOCUMENTS

| | | | |
|---|---|---|---|
| 1,471,760 | 10/1923 | Ursino | 37/105 |
| 2,599,490 | 6/1952 | Seminario | 37/104 X |
| 3,699,894 | 10/1972 | Plasser et al. | 104/2 |
| 4,010,691 | 3/1977 | Theurer et al. | 104/7 A |

FOREIGN PATENT DOCUMENTS

| | | | |
|---|---|---|---|
| 227,751 | 11/1962 | Austria | 104/2 |
| 2,264,918 | 3/1974 | France | 171/16 |

*Primary Examiner*—Randolph A. Reese
*Attorney, Agent, or Firm*—Hans Berman

[57] ABSTRACT

A ballast conditioning machine which removes ballast from railroad tracks by means of a digging chain conveyor driven transversely through the ballast below the normal rail level travels on the rails on wheels and alternatively travels on caterpillar tracks over track sections from which switches or crossings were removed to give the conveyor full access to the ballast.

5 Claims, 2 Drawing Figures

METHOD FOR REMOVING BALLAST FROM RAILROAD TRACKS

This invention relates to the reconditioning of railroad tracks, and particularly to a method for removing ballast from railroad tracks.

It is known to remove ballast from a railroad track by passing a digging or excavating chain through the ballast under the rails of a track and over a drive mechanism on a reconditioning car in a closed loop transverse to the direction of car travel on the rails, and to drive the chain while the car moves along the rails to remove ballast from under the rails. The removed ballast may be cleaned by screening and returned to the track. The ballast under switches and crossings does not readily lend itself to removal in this manner even if the effective length of the chain under the rails can be increased. It was necessary heretofore to withdraw the opened chain and to clean a section of track including a switch or a crossing either by hand or by special equipment which requires previous removal of such a track section and is not capable of removing ballast from under ordinary rails.

It is a primary object of this invention to provide a method of ballast removal from a railroad track which relies on a digging chain for ballast removal, the chain operating in track sections having ordinary rails as well as in sections including a switch or a crossing.

In one of its basic aspects, the invention provides a method of removing ballast from a railroad track including rails and ballast under the rails in which the rails are removed from a rail section which may include a switch, a crossing, or any other obstacle to conventional digging chain operation. A track conditioning car is placed on a rail section preceding the railless section. The car carries a digging conveyor, such as a digging or scraping chain, and a drive mechanism for the conveyor and is equipped with rail engaging wheels which transmit at least a portion of the car weight to the rails of the track.

The conveyor is passed through the ballast under the rails of the track and over the car in a closed loop, and is driven in this loop while the car is moved on the track in a direction toward the railless section until the leading part of the car is located above the ballast of that section, whereby ballast is removed from under the rails of the preceding section. The car weight is transferred from the rail engaging wheels to a cross country vehicle which engages the leading part of the car and movably engages the ballast of the railless section. Thereafter, the car continues moving in the same direction while supported on the vehicle until the wheels are located above the rails of a track section next to the railless section. During this car movement, the conveyor is driven through the ballast of the railless section and at least partly removes the same.

The wheels are engaged with the rails of the next track section and the weight of the car is transferred to the wheels from the cross country vehicle. When the car then is moved further, the driven conveyor engages the ballast under the rails supporting the car and at least partially removes ballast. After the railless section is completely relieved of the car weight by transfer of the weight to the next section, the removed ballast of the railless section may be replaced and rails may again be installed thereon to connect the rails of the preceding and the next track sections.

The preferred apparatus for carrying out this method includes a car equipped with rail engaging wheels adapted to travel on engaged rails in a normal direction longitudinal of the rails. A digging conveyor is mounted on the car for movement in a closed loop transverse to the normal direction of car movement and envelops the car. The conveyor may be driven by a drive mechanism on the car. A cross country vehicle adapted to travel on a surface free from rails in the direction of normal car travel is mounted on the car in such a manner that the wheels and the vehicle define respective parallel planes of travel through which the loop of the conveyor passes. One of the planes, preferably the one defined by the vehicle, may be shifted transversely relative to the other plane.

Other features, additional objects, and many of the attendant advantages of this invention will readily be appreciated as the same becomes better understood by reference to the following detailed description of a preferred embodiment when considered in connection with the appended drawing in which.

Figure 1:
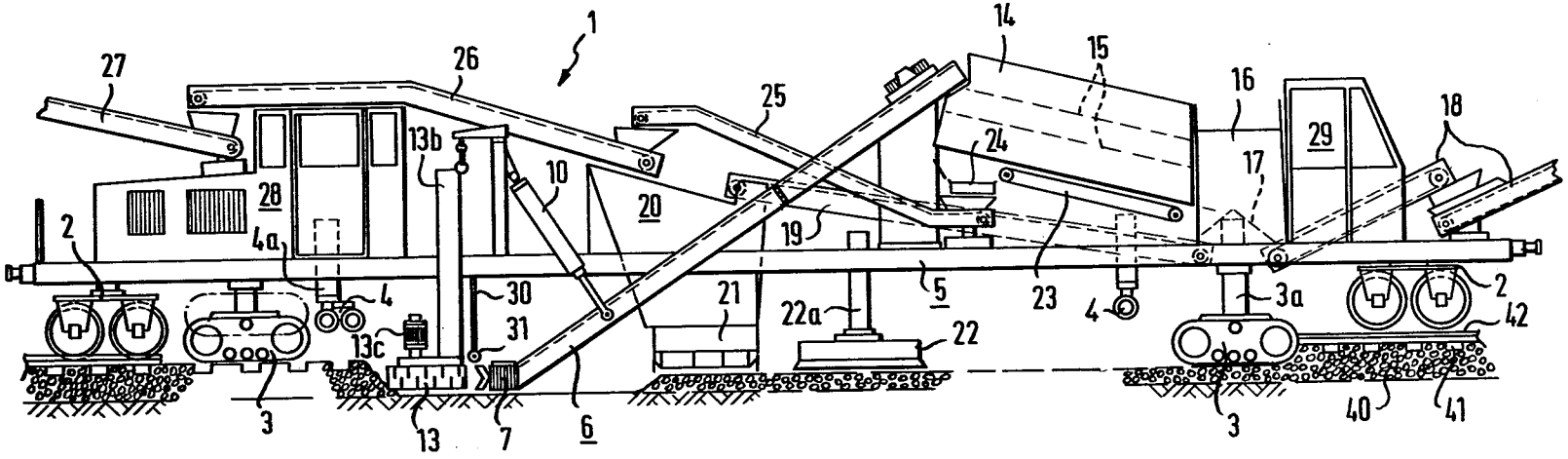
FIG. 1 shows apparatus of the invention in side elevation.

As shown in FIG. 1, the apparatus is located on a railroad track normally consisting of ballast 40 in which ties 41 carrying rails 42 are embedded. From a central section of the illustrated track portion, the rails of a switch or crossing were removed in an operation preceding the illustrated condition.

The apparatus includes a car 1 whose front and rear ends are equipped with wheeled trucks 2 for weight transmitting engagement with the rails 42. Next to each of the two trucks 2 toward the center of the car, the caterpillar tracks of a cross-country vehicle 3 are mounted by means of hydraulic jacks 3*a* which permit the vehicles 3 to be raised and lowered through the tangential plane defined by the wheels on the trucks 2 and permit angular movement of the vehicle through acute angles of less than 30° for travel through curves of the track. Further toward the center of the car 1 from the two tracked vehicles 3, two sets of auxiliary, rail-engaging wheels 4 are mounted on the car 1 on each side by means of hydraulic jacks 4*a* which permit the auxiliary wheels 4 to be shifted vertically through the afore-mentioned plane of the wheels on the trucks 2 as well as the parallel planes defined by the caterpillar tracks of the two vehicles 3 in the several vertical positions of the vehicles.

The frame 5 of the car 1, in addition to the trucks 2, vehicles 3, and auxiliary wheels 4, carries a conventional diesel-electric generator and a pump for hydraulic fluid obscured in the drawing by a housing 28 which also encloses an operator's cab at the end of the car 1 which is the leading end during normal car travel. Another cab 29 is provided at the trailing car end to shelter another operator.

Figure 2:
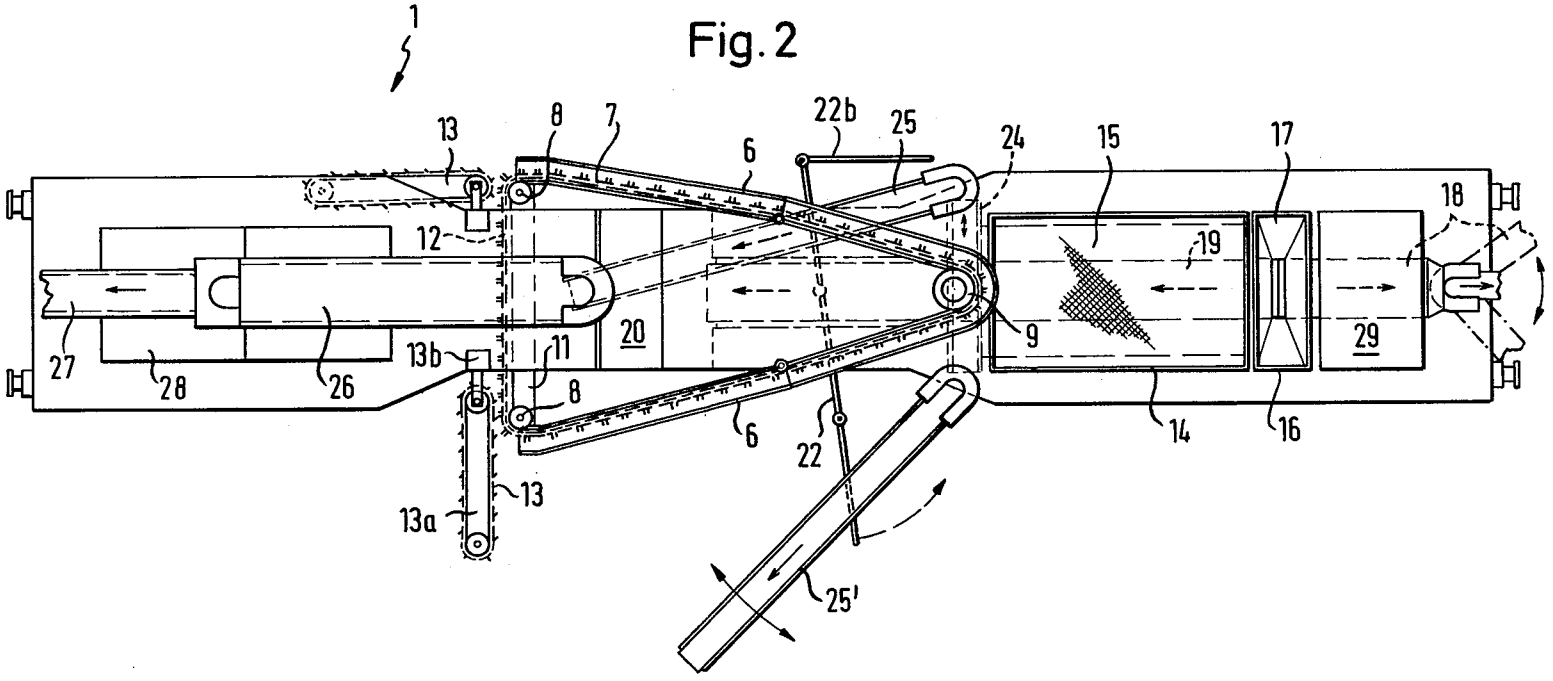
FIG. 2 is a top plan view of the apparatus of FIG. 1.

Two elongated troughs 6 slope obliquely forward and downward from a fixed junction above the frame 5 and diverge laterally downward, as is better seen in FIG. 2. A digging or scraping conveyor chain 7 is trained in a triangular loop over two pulleys 8 at the lower ends of the troughs 6 and over a pulley 9 at the junction of the troughs. At least the pulley 9 is driven by a non-illustrated electric motor. The lower section of each trough 6 is pivotally linked to the fixed upper section and may be raised by a hydraulic jack 10. A transverse beam 11 connects the lower ends of the troughs 6 and backs the approximately horizontal, transverse run 12 of the chain 7 which passes under the car so that the loop of the chain, partly received in the troughs 6, envelops the car 1.

Another scraping chain 13 is carried by a straight guide bar 13*a* on either side of the frame 5 near respective pulleys 8. One end of the bar 13*a* is attached to a hydraulic lift 13*b* on the frame 5 which permits the bar 13*a* with the chain 13 to be raised and lowered, but also to be pivoted about the vertical axis of the lift by means of a hydraulically operated turning mechanism, conventional in itself and not explicitly shown. The free end of the bar 13*a* carries an electric motor —*c* which drives the chain 13 and is representative of other electric prime movers employed for energizing and adjusting the operating devices of the car, including the wheels of the trucks 2, the tracks of the vehicles 3, and the auxiliary wheels 4, as is conventional in self-propelled railroad cars.

A box 14 has an open top below the pulley 9 and the portion of the chain 7 trained over the pulley, and encloses two vibratory screens 15 which slope obliquely rearward. Relatively large objects conveyed by the chain 7 to the box 14 are retained by the upper screen 15 while the mesh size of the lower screen is selected to pass small waste particles and retain ballast stones of desirable size which slide into a receptacle 16.

The bottom 17 of the receptacle 16 slopes forward and rearward toward non-illustrated gates. One of the gates opens rearwardly toward a sectionalized discharge conveyor 18. The far, or rear, end of the conveyor 18 may be swung laterally between positions shown in broken lines in FIG. 2 for delivering cleaned ballast to the two shoulders of the track. The other gate opens toward a belt conveyor 19 whose discharge end is located above a bin 20 near the center of the frame 5. A spreader 21 at the bottom of the bin 20 controls the rate of downward discharge of cleaned ballast from the bin and also controls the width of the track over which the cleaned ballast is distributed. The spreader 21 may be raised and lowered relative to the bin 20 by non-illustrated jacks.

The undersize waste separated from the ballast by the screens 15 is collected by a conveyor 23 under the lower screen 15 in the box 14 and discharged through a chute to the loading end of a string of belt conveyors 24, 25, 26, 27 extending beyond the leading end of the car 1 so that the waste material may be dropped into a non-illustrated car normally pushed by the conditioning car 1 over the rails 42. The first, transverse conveyor 24 of the string is reversible so that it may alternatively direct the waste material to a conveyor 25′ one end of which is pivoted to the frame 5 to permit the free end to be positioned above a dump truck traveling on or near the shoulder of the track.

A hydraulic jack 22*a* located behind the spreader 21 in the normal direction of car travel carries a horizontal leveling blade 22 whose hinged end portions 22*b* may be pivoted by non-illustrated hydraulic adjusters to vary the effective transverse length of the blade. Power operated rail tongs 30 mounted on the underside of the frame 5 and carrying rotary jaws 31 at their free lower ends permit rails to be lifted from the scraping zone of the transverse chain run 12 when the chain moves transversely under rails 42 in a manner not shown in the drawing.

The track conditioning car 1 may be operated practically without interrupting movement of the car in its normal traveling direction to clean ballast by means of the embedded chain 7 under sections of the track carrying rails 42 and under other sections from which rails, switches, crossings and the like were previously removed together with the associated ties.

The car is first driven on its wheeled trucks 2 to a first track section extending toward the right from the track portion shown in FIG. 1, and the auxiliary wheels 4 on the leading part of the car 1 are lowered into weight transmitting engagement with the rails of the first section, while the vehicles 3 are retracted upward from the plane jointly defined by the rails 42 and the engaging wheels of the trucks 2. During continued car travel (leftward as viewed in FIG. 1), the wheels on the leading truck 2 and the tracked vehicles 3 interposed between the truck and the frontal set of auxiliary wheels 4 are positioned spacedly above a second track section, shown in the center of FIG. 1, from which obstacles to normal operation of the scraping chain 7, such as switches or crossings, were removed together with the associated ties, leaving behind the ballast 40 whose top surface is transversely grooved where the ties 41 were previously located.

The leading tracked vehicle 3 is then lowered through the plane tangentially defined by the rail engaging wheels until its tracks engage the ballast 40 in the railless section. During continued forward movement, the weight of the car 1 initially supported on the leading auxiliary wheels 4 is transmitted to the leading vehicle 3 whose tracks are driven by non-illustrated electric motors on the ballast surface while the wheels 4 are withdrawn toward the frame 5 and/or overtravel the ends of the rails 42 between the first and second sections. Eventually, the retracted auxiliary wheels 4 and the retracted vehicle 3 at the trailing end of the car 1 travel beyond the rails of the first section and are located above the railless section. The trailing vehicle 3 is then lowered into contact with the roadbed still covered with some ballast to relieve the trailing truck 2 of its portion of the car weight, and the condition of the trailing car end shown in FIG. 1 is reached.

Depending on the length of the railless second section, the truck 2 on the leading car part may reach a position above the rails 42 of the third track section, on the left, as viewed in FIG. 1, before or after the rear truck 2 leaves the rails of the first section. The weight of the car 1 may then be transferred from the leading vehicle 3 to the leading truck 2 by raising the vehicle from the position fully drawn in FIG. 1 to the position indicated in chain-dotted lines. When the trailing end of the car 1 reaches the end of the second section, a position is reached in which the auxiliary wheels 4 of the trailing car part are located above the rails 42 of the third section while the weight of the car is still transmitted to the ballast of the second section by the trailing vehicle 3. The trailing auxiliary wheels 4 are then lowered, and the trailing vehicle 3 is raised until the wheels 4 engage the rails in the third track section, and the vehicle 3 clears the rails. During further movement of the car 1, the wheels of the rear truck 2 are positioned above the rails of the third section and engage the last-mentioned rails when the trailing auxiliary wheels 4 are retracted.

As is not explicitly shown, the vehicles 3 may be pivoted about a vertical axis to steer the car over a curved, railless section, and the jacks 4*a* may be shifted laterally on the frame 5 for precise alignment of the wheels 2, 4 with the rails 42 when the car weight is transmitted between the auxiliary wheels 4 and the trucks 2.

Before the car 1 starts operating on the partly illustrated first track section, enough ballast is removed manually or by auxiliary equipment from below the rails to permit the previously opened chain 7 to be passed transversely to the direction of car travel through the ballast 40 under the rails 42 and ties 41 and through the troughs 6 to the drive pulley 9 whereupon the loop of the chain 7 is closed. Throughout the car travel over the first, second, and third track sections, the chain 7 may be driven continuously and without major change in its vertical position so that ballast is scraped laterally from under the rails 42 in the first and third sections, and from the railless second section.

The main digging path of the conditioning car is defined by the length of the transverse run 12 of the chain 7 and may be adjusted to some extent by the use of a telescoping beam 11 or by replacing the illustrated beam by a shorter or longer beam, and by corresponding changes in the number of links in the chain 7. However, the effective digging path of the illustrated car 1 may be varied without interrupting the normal car movement and the normal drive of the chain 7 by swinging the two auxiliary chains 13 and their carriers 13*a* between the fully extended position illustrated in FIG. 2 with respect to the left auxiliary chain 13 and the fully retracted condition of the illustrated right auxiliary chain. The latter position is set by the operatur during travel of the car 1 along station platforms or in tunnels where the width of the track shoulder is minimal. The auxiliary digging path of a chain 13 is at its maximum in the fully extended chain position. The auxiliary digging chains 13 travel on the carriers 13*a* in a direction to scrape ballast from the shoulder of the track toward the track center and into the path of the transverse chain run 12.

The central portion of the frame 5 is laterally recessed, and the entire conveyor assembly, including the troughs 6, chain 7, pulleys 8, and beam 11, may be shifted laterally on the frame about the axis of the drive pulley 9 by non-illustrated hydraulic adjusters to retract the pulleys 8 and at least portions of the lower trough ends as may be necessary to clear station platforms and the like. FIG. 2 shows the right trough 6 to be so retracted.

The ballast removed from the track by the transverse chain run 12 is conveyed upward by the chain 7 in one of the troughs 6 and dropped on the screens 15. The fine waste material is discharged on a railroad car or a truck in the manner obvious from the above description of the conveyor sections 24, 25, 25', 26, and 27, and the cleaned ballast is returned to the track, though not normally to the track section from which it was removed earlier. The widths of the cleaned ballast bed is determined in part by the setting of the spreader 21 and in part by the angular positions of the end portions 22*b* of the leveling blade 22, the leveler operating in its full width only on the railless track sections to make them ready for receiving the returned switch or crossing rails. A tamper, not shown, may be associated with the blade 22 in a known manner.

As is inherent in the described mode of operation, the ballast is uniformly cleaned in track sections from which rails need not be removed and in other sections from which the rails of switches or crossings were removed prior to passage of the car 1. This is not readily achieved where separate equipment or manual labor is resorted to for removing the ballast from track sections including obstacles to operation of the basically conventional looped chain 7. Where the depth of the ballast is shallow, and it is not intended to remove soil from under the ballast, the rails may be lifted by the rolling jaws 31 of the tongs 30 to permit the transverse chain run 12 to be raised above the soil level by the jacks 10, the auxiliary chains 13 being similarly raised by the lifts 13*b*.

It should be understood, of course, that the foregoing disclosure relates only to preferred embodiments of the invention, and that it is intended to cover all changes and modifications of the example of the invention herein chosen for the purpose of the disclosure which do not constitute departures from the spirit and scope of the invention set forth in the appended claims.

What is claimed is:

1. A method of removing ballast from a railroad track having first, second, and third consecutive sections, the track in each section including rails and ballast under the rails which method comprises:

(a) removing said rails from said second section;

(b) placing a car on said first section, (1) the car carrying a digging conveyor and drive means for the conveyor, (2) the car including rail engaging wheels transmitting at least a portion of the weight of the placed car to the rails of said first section;

(c) passing said conveyor through the ballast under the engaged rails of said first section and over said car in a closed loop, whereby said conveyor is partly embedded in said ballast;

(d) moving said car on said track in a direction from said first section toward said third section until a part of said car is located above the ballast of said second section;

(e) transferring said portion of said weight from said rail engaging wheels to a cross country vehicle supporting said part of the car and movably engaging the ballast of said second section;

(f) further moving said car in said direction while supported on said vehicle until said wheels are located above said third section;

(g) engaging said wheels with the rails of said third section and transferring said portion of said weight from said vehicle to the engaged wheels;

(h) additionally moving said car in said direction;

(i) keeping said conveyor, while extending in said closed loop, partly embedded in said ballast during said moving, said further moving, and said additionally moving of said car until said conveyor engages the ballast of said third section; and (j) driving said conveyor in said loop during said moving, said further moving, and said additionally moving, whereby ballast is removed from each of said first, second, and third sections.

2. A method as set forth in claim 1, wherein said conveyor is driven in said loop continuously during said further moving and said additionally moving said car.

3. A method as set forth in claim 2, wherein said car moves continuously during said further moving and said additionally moving thereof.

4. A method as set forth in claim 1, wherein said conveyor is driven in said loop continuously during said moving and said further moving.

5. A method as set forth in claim 1, wherein said additionally moving is continued until said conveyor is withdrawn from said second section and the entire weight of said car is transmitted to said third section by said wheels, the ballast removed from said second section thereafter being replaced, and rails being installed on the replaced ballast of said second section to connect the rails of said first section to the rails of said third section.

* * * * *